United States Patent [19]

Dranselka

[11] 4,262,902

[45] Apr. 21, 1981

[54] PORTABLE EXERCISE DEVICE

[76] Inventor: Marvin A. Dranselka, R.R. #1, Wayne, Nebr. 68787

[21] Appl. No.: 55,249

[22] Filed: Jul. 6, 1979

[51] Int. Cl.[3] ..... A63B 21/22

[52] U.S. Cl. ..... 272/132; 272/143; 272/73; 272/900

[58] Field of Search ..... 272/73, 132, 131, DIG. 3, 272/93, 900; 128/25 R

[56] References Cited

U.S. PATENT DOCUMENTS

| | | | |
|---|---|---|---|
| 2,668,709 | 2/1954 | Boyka | 272/132 |
| 3,259,385 | 7/1966 | Boren | 272/73 |
| 3,751,033 | 8/1973 | Rosenthal | 272/73 X |
| 4,186,920 | 2/1980 | Fioro et al. | 272/132 X |

FOREIGN PATENT DOCUMENTS

| | | | |
|---|---|---|---|
| 2390179 | 1/1979 | France | 272/73 |

*Primary Examiner*—William R. Browne
*Attorney, Agent, or Firm*—Henderson & Sturm

[57] ABSTRACT

A portable pedaling type exercise device which is attachable to a conventional chair without alteration includes a rear member which is held rigidly between a pair of opposing legs of a chair by the application of compressive force. Flexibility in the location of the pedal assembly in relation to the chair and floor is achieved through adjustable length members of the supporting frame. A direct mechanism for applying selective drag to the pedal shaft and removable stirrups for securing feet to the pedals are also provided.

6 Claims, 9 Drawing Figures

PORTABLE EXERCISE DEVICE

BACKGROUND OF THE INVENTION

1. Field of the Invention

This invention relates to portable pedaling type exercise devices of a type to be used in conjunction with conventional chair frames, bed frames, wheel chair and the like. This invention relates more particularly to pedal exercise devices with kinesitherapeutic applications for convalescing, elderly and/or handicapped persons whose treatment requires a less expensive portable and easily-stowable device.

2. Description of the Prior Art

A portable pedaling-type exercise device whereby a conventional chair is utilized and the device is held stationary with respect to a pair of opposing legs of a chair is described in U.S. Pat. No. 3,259,385.

According to U.S. Pat. No. 3,259,385, a transverse foot is provided which rests on the floor behind two opposing legs of the chair. The transverse foot is provided with two anchor tabs which freely slide along said foot and which serve to further restrain the device in relation to the chair by being positioned under each of the chair legs. A variation in the force required to actuate the pedals is provided by means of adjusting the tension on one end of a padded arcuated spring, the other end being fixed, the spring contacting a brake cylinder affixed to the pedal axle.

SUMMARY OF THE INVENTION

The improved portable pedaling-type exercise device according to the present invention discloses a rear member which is held in a fixed position between a pair of opposing legs of a chair, or forward vertical members of a wheel chair. This member consists of a center section which contains telescoping sections on either end, each of which have crescent-shaped end pieces. The crescent-shaped end pieces are held against the inside surface of the legs, at a selected height above the floor, by maintaining sufficient compression through the use of two set-screws.

The present exercise device also includes structure for adjusting the position of the pedal assembly in relation to the floor, as well as in relation to the chair, affording flexibility in reference to the user's size and/or therapy desired. This feature is accomplished partially by providing two members, the lengths of which can be adjusted through telescopic means. One is generally horizontal member which is rigidly attached to the transverse rear member of the device (which is held rigidly between the chair legs) at one end and rigidly attached to the pedal assembly at the other end. The other is a generally vertical member which is rigidly attached to the underside of the pedal assembly at one end and attached by means of a hinge to a suppporting and stabilizing base plate at the other end. In addition to the ability to vary the position of the pedal assembly by means of the telescoping feature, another means is provided through the ability to fix the transverse rear member at various positions vertically along the chair legs.

Another feature of the present invention is that it utilizes a conventional manufactured pedal assembly with ball bearings and main shaft. This discloses a means by which the essential moving elements which are subject to the greatest wear and stress are provided with optimum quality at minimum cost. In addition, the invention discloses a means by which variable drag may be transmitted to the pedal shaft in a simple, trouble-free manner. The one wearing part is an inexpensive strip of standard brake lining material which can be easily and economically replaced by an unskilled user.

It is an object of this exercising device to provide a means by which the feet of those with more extreme handicaps, such as the elderly or stroke victims, may be securely held on the pedals. In accordance with this object of the invention, stirrups are provided which may be easily and quickly affixed to the conventional pedals of the conventional pedal assembly at varying positions to accomodate different foot sizes. Velcro straps are disclosed which provide an inexpensive means by which the aforementioned handicapped persons could most likely be able to secure their feet to the stirrups unassisted.

In addition to usual applications of exercise devices by the healthy where low cost, minimal weight, and portability are desirable features, these same attributes are particularly advantageous in kinesitherapeutic applications. It is often the case that a convalescing patient cannot afford a conventional pedal-type exercise device with cycle seat and handle-bars, nor does he have the space at home for one, nor can be balance himself on one safely or confidently. The instant invention has the advantage of utilizing a conventional chair in lieu of expensive and space-consuming portions of the latter type device. These and other features set forth above and below also make this invention particularly well suited to use by therapists who must bring the pedaling device to the patient either by carrying the device inside a hospital or nursing home, and/or by transporting it in his automobile to where the patient is residing.

Further features, objects and advantages of this invention will be apparent from a consideration of the following drawings and description which incorporates said drawings.

DESCRIPTION OF THE PREFERRED EMBODIMENT

Figure 1:
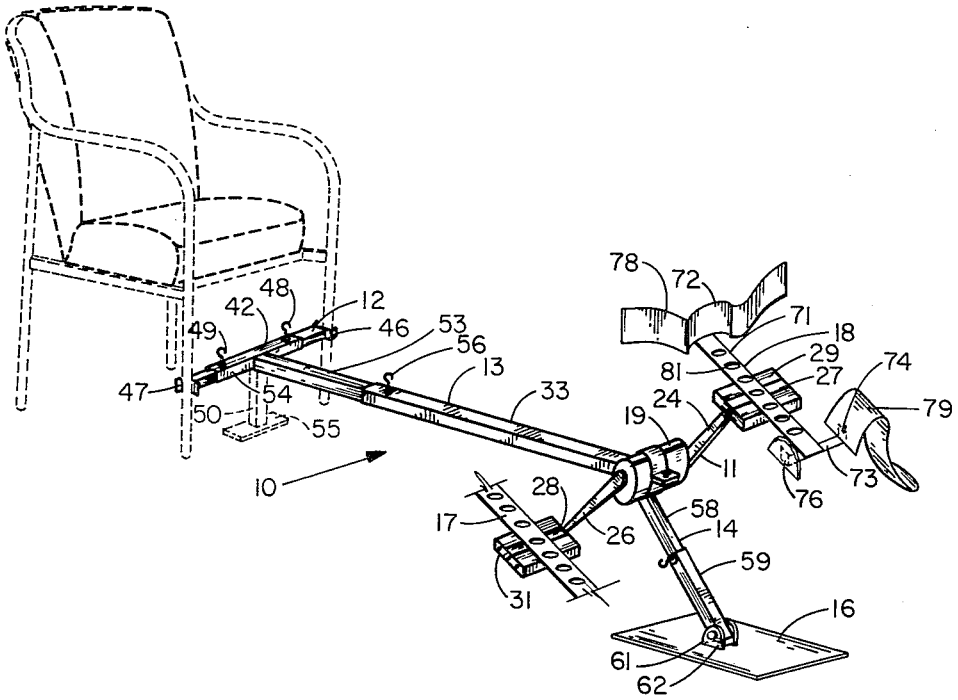
FIG. 1 is a perspective view of one embodiment of the present invention depicting a stirrup attached to one of the two pedals.
Figure 2:
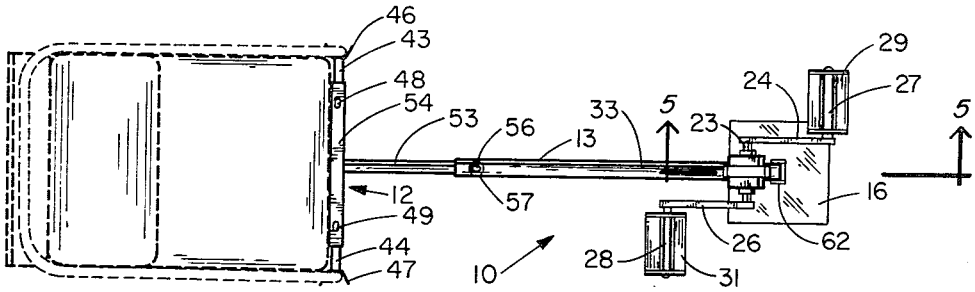
FIG. 2 is a top plan view of the invention.
Figure 3:
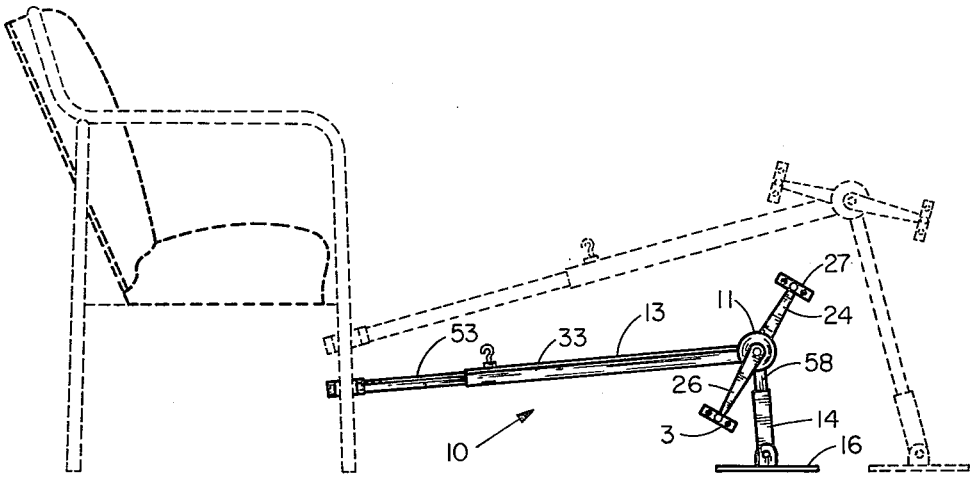
FIG. 3 is a side elevational view of the invention depicting the pedal assembly held in one location and held in another location schematically by the use of broken lines.
Figure 9:
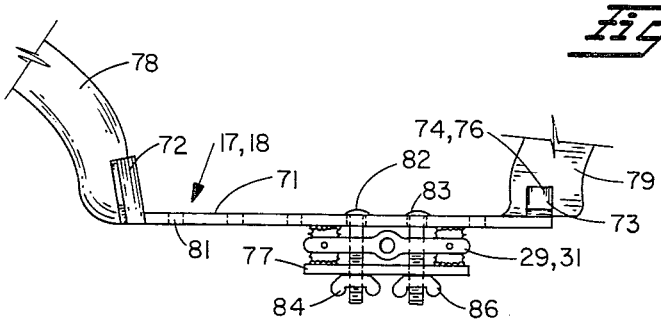
FIG. 9 is an enlarged side elevational view of a foot stirrup and a pedal to which it is attached.

Referring now to the drawings, wherein like reference numerals designate identical or corresponding parts throughout the several views, a portable exercise device designated generally by the numeral 10 is depicted entirely in FIGS. 1, 2 and 3. It is comprised of a conventional cycle pedal assembly 11 (FIG. 4 and 5), an adjustable length transverse rear member 12, (FIG. 6), an adjustable length horizontal connecting member 13, an adjustable length vertical supporting member 14, a supporting base plate 16 (FIGS. 7 and 8), and removable stirrups 17 and 18 as seen in FIGS. 1 and 9.

Figure 4:
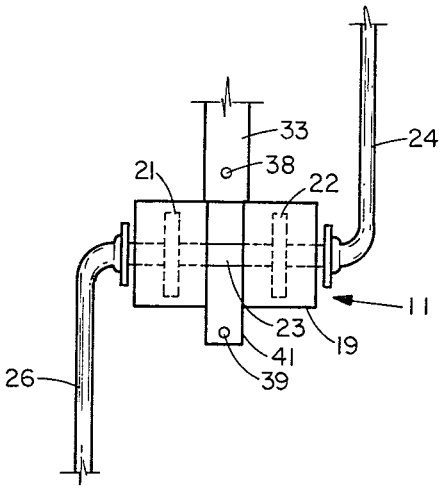
FIG. 4 is an enlarged fragmentary top plan view of the pedal assembly without the frictional drag parts in place.
Figure 5:
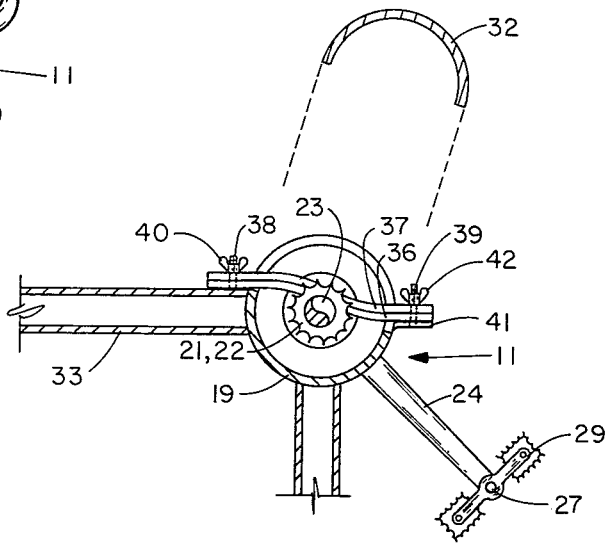
FIG. 5 is an enlarged fragmentary vertical sectional view of the pedal assembly with the frictional drag parts in place taken along line 5—5 of FIG. 2.

The conventional pedal assembly 11 as seen in FIGS. 4 and 5 is of a type which is readily available from various bicycle manufacturers. Such a unit includes the following basic parts: a housing 19 which contains split ball bearings 21 and 22, in which the main shaft 23 freely rotates, to which is rigidly attached at either end pedal cranks 24 and 26, to which cranks pedal axles 27 and 28 are rigidly attached, and about which pedal axles 27 and 28 pedals 29 and 31 freely rotate.

Referring now to FIGS. 4 and 5, it can be seen that conventional pedal assembly 11 is economically adapted to provide a means whereby the amount of force required to actuate the pedals 29 and 31 can be varied. This end is accomplished by cutting from the housing 19 a section 32, centered between the split ball bearings 21 and 22, and above the top of the sleeve section 33 of the horizontal connecting member 13 where it is rigidly connected to the housing 19 (at about the 10:00 o'clock position) to a location far enough down the opposite and front side of the housing 19 (at about the 4:00 o'clock position) to permit a strip of brake lining type material 36 to be forceably held by a rigid conforming strap 37 across a sufficient surface area of the main shaft 23 to produce the desired amount of frictional drag. The strip of brake lining type material 36 and rigid conforming strap 37 are provided each with two holes to fit over threaded posts 38 and 39. Post 38 is rigidly attached vertically to the top of sleeve portion 33 and post 39 is rigidly attached vertically to a horizontally projecting tab 41 which is rigidly attached on the front side of housing 19, flush with the lower end of the opening left by the removal of center section 32. The frictional drag applied to axle 23 may be varied by adjusting the wing nuts 40 and 45 after the strip of brake lining type material 36 and the rigid conforming strap 37 are in place as depicted in FIG. 5.

Figure 6:
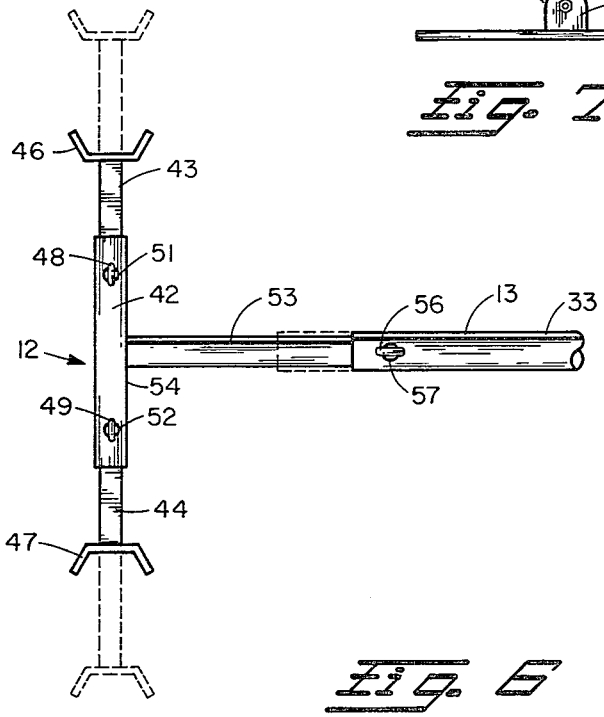
FIG. 6 is an enlarged top plan view of the rear portion of the supporting frame depicting the transverse rear member.

Referring now to FIG. 6, it may be seen that the adjustable length transverse rear member 12 is comprised of a sleeve portion center section 42 and two insert sections 43 and 44, each with crescent-shaped horizontally oriented end pieces 46 and 47. Rear member 12 is held snugly at the desired height above the floor between the inner sides of two opposing chair legs by set screws 48 and 49 which operate in threaded holes 51 and 52 in the top of center section 42.

As depicted in FIGS. 1, 2 and 6, the adjustable length horizontal connecting member 13 is comprised of a sleeve portion 33 which is welded to the rear surface of housing 19 and an insert section 53 which is rigidly connected to a vertical face 54 of the center-point of the center section 42 of the transverse rear member 12. The distance the pedal assembly 11 is away from the chair may be varied by fixing the insert section 53 within the sleeve section 33 of the connecting member 13 at the desired location by use of a set screw 56 which operates within threaded hole 57 in the top surface of sleeve portion 33.

Figure 7:
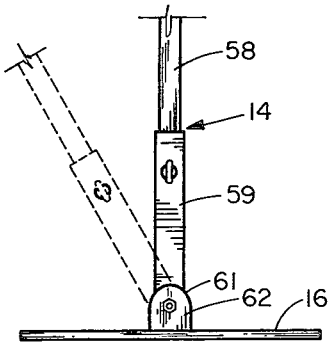
FIG. 7 is an enlarged side elevational view of a portion of the structural frame depicting the supporting vertical member and the base plate.
Figure 8:
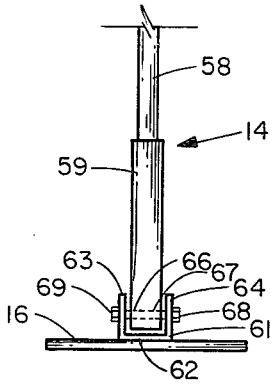
FIG. 8 is an enlarged front elevational view of a portion of the supporting frame depicting the vertical supporting member and the base plate.

Referring now to FIGS. 7 and 8, the adjustable length vertical supporting member 14 is comprised of an insert section 58 which is rigidly connected to the underside of the housing 19 and a sleeve section 59 which is connected to base plate 16 by a hinge 61. Hinge 61 consists of a bifurcated block 62 secured to the center of base plate 16, four aligned holes 63, 64, 66 and 67, two of which are in the projecting members of block 62 (63 and 64) and two of which are in the lower end of sleeve section 59 (66 and 67), a threaded pin 68, and a wing nut 69. The wing nut 69 may be tightened after the desired position of the pedal assembly 11 in relation to the chair and the floor is selected, thus offering an additional means of maintaining the rigidity of the entire device 10 after it is affixed to the chair while permitting the base plates 16 to be positioned perfectly flush with the floor, thus further achieving maximum stability.

Referring now to FIGS. 1 and 9, it may be seen that removable stirrups 17 and 18 each is comprised of an upper sole plate 71, with a vertical heel plate 72 and a transverse toe piece 73 with vertical upper projecting toe tabs 74 and 76, a lower two-holed washer plate 77, and Velcro-type fastener heel strap 78 and toe strap 79. The sole plate 71 is provided with a plurality of holes 81 spaced along its longitudinal axis in such fashion as to permit screws 82 and 83 to be placed in two adjacent holes which are selected to achieve the desired position on the pedals 29 and 31. Sole plate 71 is held firmly against the top of the pedals by means of the two-holed washer plate 77, the two wing nuts 84 and 86, and threaded screws 82 and 83. The user's foot is held in place in the stirrups by the Velcro-type fastener heel strap 78 and toe strap 79.

An optional support feature including a rigid support leg 50 and a floor plate 55 welded to the bottom thereof is shown in dashed lines in FIG. 1. The member 50 can be permanently connected to the member 42, such as by welding, or it can be removeably connected thereto by use of any number of conventional fastening devices such as nuts and bolts or a hinge having a removeable pin.

Other modifications and variations of the present invention are possible and it is to be understood that, within the scope of the appended Claims, the invention may be practiced otherwise than as herein specifically described.

I claim:

1. A portable exercise device for attachment to a chair comprising:

a pedal assembly including a housing, a shaft rotatably disposed through said housing, and a pedal means attached to said shaft for rotating said shaft in response to the movement of a person's feet;

a horizontal connecting member rigidly attached to said housing;

a vertical supporting member rigidly attached to said housing and depending therefrom substantially perpendicularly with respect to said horizontal connecting member;

a pivotable base plate means attached to said vertical supporting member for varying the height of said device at its end distal a chair; and transverse rear means for attaching said horizontal connecting member to two opposed legs of a chair that receives a user, wherein said attaching means includes:

a sleeve portion center section rigidly attached approximately at its mid-point to the end of the horizontal connecting member distal the housing;

insert means for telescoping within said sleeve portion center section;

end piece means attached to said insert means for receiving each of two opposing chair legs; and holding means for adjusting the length of said transverse rear attaching means in order that it may be operably attached to two opposing legs of a chair at any desired width.

2. A device as defined in claim 1 including means for adjusting the effective length of said horizontal connecting member.

3. A device as defined in claim 1 including means for adjusting effective length of said vertical supporting member.

4. A device as defined in claim 1 including stirrup means removably attached to said pedals including straps with Velcro fastening means thereon.

5. A device as defined in claim 1 including drag applying means for varying the force required to turn said shaft, wherein said drag applying means comprises:

a rigid conforming strap extending across and adjustably attached at both ends to said housing for varying the amount of pressure applied to said shaft; and, a brake lining type material means, for contacting the main shaft, attached to the unexposed side of the rigid conforming strap in order that a sufficient surface area of said shaft be contacted to produce the desired amount of frictional drag.

6. A device as defined in claim 1 further including floor plate and support means for additional strength in maintaining the chair attachment means a specific height above the floor and rigidly attached and depending from the sleeve portion center section of the chair attaching means.

* * * * *